US011401637B2

(12) United States Patent
Costa Saravia

(10) Patent No.: US 11,401,637 B2
(45) Date of Patent: Aug. 2, 2022

(54) THREAD TENSIONER FOR RETRACTABLE CROCHET WEAVE

(71) Applicant: Maria Ines Costa Saravia, Montevideo (UY)

(72) Inventor: Maria Ines Costa Saravia, Montevideo (UY)

( * ) Notice: Subject to any disclaimer, the term of this patent is extended or adjusted under 35 U.S.C. 154(b) by 794 days.

(21) Appl. No.: 16/370,926

(22) Filed: Mar. 30, 2019

(65) Prior Publication Data

US 2019/0368094 A1 Dec. 5, 2019

(51) Int. Cl.
*D04B 3/04* (2006.01)
*D05B 47/02* (2006.01)

(52) U.S. Cl.
CPC ..... *D04B 3/04* (2013.01); *D05B 47/02* (2013.01)

(58) Field of Classification Search
CPC ... D04B 3/04; D04B 3/00; D04B 3/06; D05B 47/00; D05B 47/02; B65H 59/16; B65H 59/22
See application file for complete search history.

(56) References Cited

U.S. PATENT DOCUMENTS 1,340,541 A * 5/1920 Hansen ..... D04B 3/00 242/153
1,500,616 A * 7/1924 Henley ..... D04B 33/00 242/149
1,502,799 A * 7/1924 Rees ..... D04B 33/00 242/150 R
1,577,658 A * 3/1926 Helen ..... D04B 3/00 242/150 R
2,021,946 A * 11/1935 Riely ..... D04B 3/00 242/149
2,142,608 A * 1/1939 Hockert ..... D04B 3/00 66/1 A
2,423,211 A * 7/1947 Vanselow ..... D04B 3/00 242/153
2,434,609 A * 1/1948 Coffey ..... D04B 3/00 66/146
2,472,702 A * 6/1949 Greenstein ..... D04B 3/00 66/1 A
2,513,851 A * 7/1950 Dodds ..... A41H 31/00 66/1 A
2,539,568 A * 1/1951 Booth ..... D04B 3/00 242/153
2,691,493 A * 10/1954 Burkhart ..... D04B 3/00 242/149
4,037,433 A * 7/1977 Weber ..... D04B 3/04 242/147 R
4,370,870 A * 2/1983 Kroh ..... D04B 3/00 66/1 A
4,643,341 A * 2/1987 Hostetler ..... D05B 91/04 66/1 A (Continued)

*Primary Examiner* — Danny Worrell
(74) *Attorney, Agent, or Firm* — Hoglund & Pamias, PSC; Roberto J Rios

(57) ABSTRACT

A device for keeping a thread tightened and secured while weaving is provided. The thread is allowed to advance in order to make a stitch and further allows the thread to return to an original position so that it remains tensioned for the next stitch. The device is retractable so not only secures the thread but returns it so that it never loses tension. In addition, it has openings designed to allow resting a needle when not weaving.

19 Claims, 19 Drawing Sheets

(56) References Cited

U.S. PATENT DOCUMENTS

| | | | | | |
|---|---|---|---|---|---|
| 4,713,947 | A * | 12/1987 | Collins | ..... | D04B 3/00<br>242/157 R |
| 2008/0257994 | A1 * | 10/2008 | Comotto | ..... | B65H 59/22<br>242/147 M |

* cited by examiner

THREAD TENSIONER FOR RETRACTABLE CROCHET WEAVE

FIELD OF THE INVENTION

The invention is directed to a device for keeping a thread tightened and secured while weaving and allows the thread to advance in order to make a stitch and further allows the thread to return to an original position so that it remains tensioned for the next stitch. The invention is specifically directed to a device that is retractable, not only does it tighten, but then it returns so that it never loses that tension. In addition, it has openings designed to allow resting the needle when it one stops weaving.

SUMMARY OF THE INVENTION

According to an aspect of the present invention, a thread passes through the inventive device so that the thread is pressed and secured while the thread is being pulled until a detent is reached where the thread is no longer pressed allowing free movement of the thread. When the stitch is done and the thread is not being pulled anymore, the thread is again pressed and secured and it returns to an original position because the device has a retractable feature.

According to another aspect of the present invention, the thread tensioner of the invention is held by a ring that is placed on a user's finger, allowing weaving without interference from the aforementioned device.

According to still another aspect of the present invention, the device can be used on a thread at any point, it is not necessary to begin weaving with the device or finish weaving with it as the device can be removed or used at any time.

According to yet another aspect of the present invention, the needle used is held by the device so that when the weaver rests, the weave is not separated or comes apart.

According to an aspect of the present invention, the device has an element that will serve as a stop so that the thread is released and the stitch can be made.

According to another aspect of the present invention, an elastic element is provided that is in constant tension and serves to provide the retractable feature of the device.

BRIEF DESCRIPTION OF THE DRAWINGS

Further features and advantages of the invention will become apparent from the following detailed description taken in conjunction with the accompanying figures showing illustrative embodiments of the invention, in which.

Throughout the figures, the same reference numbers and characters, unless otherwise stated, are used to denote like elements, components, portions or features of the illustrated embodiments. The subject invention will be described in detail in conjunction with the accompanying figures, in view of the illustrative embodiments.

DETAILED DESCRIPTION OF THE INVENTION

Figure 1A:
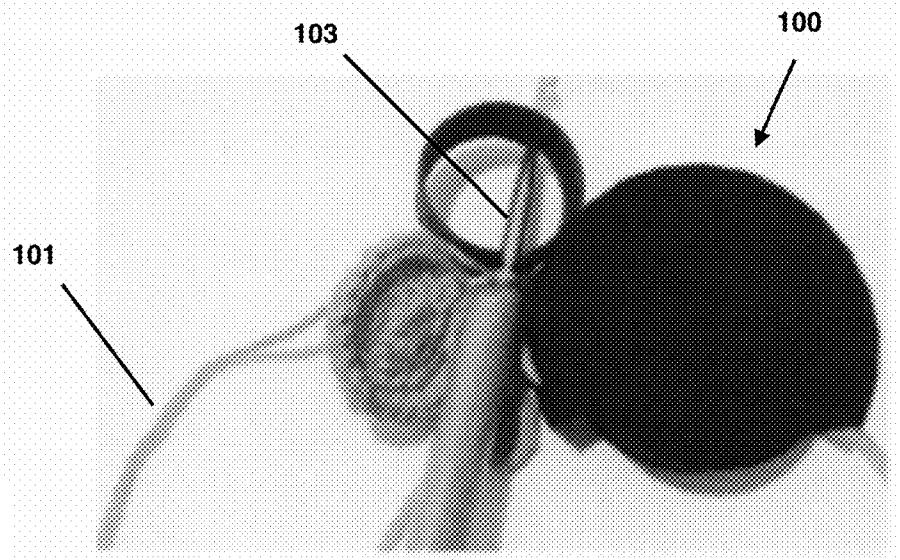
FIG. 1*a* shows the thread tensioner device holding a needle, according to the present invention.
Figure 1B:
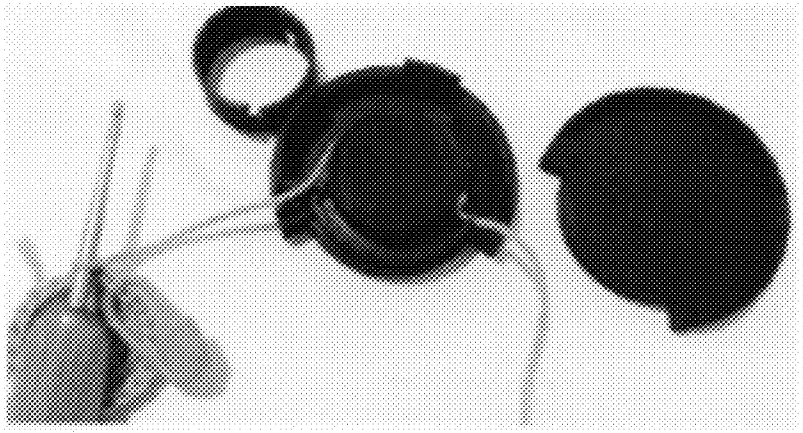
FIG. 1*b* shows the thread tensioner device with the upper lid removed, according to the present invention.

A thread tensioner device 100 of the present invention is shown in FIG. 1*a* holding a thread needle 103 while the thread 101 is not being used. FIG. 1*b* shows the thread tensioner device 100 with its upper lid off so the tensioner structure can be appreciated. The thread tensioner device of the invention is a relatively small device that can be easily hold by an integrated finger insert which can be also used to hold the thread needle 103 as shown in FIG. 1*a*.

Figure 2:
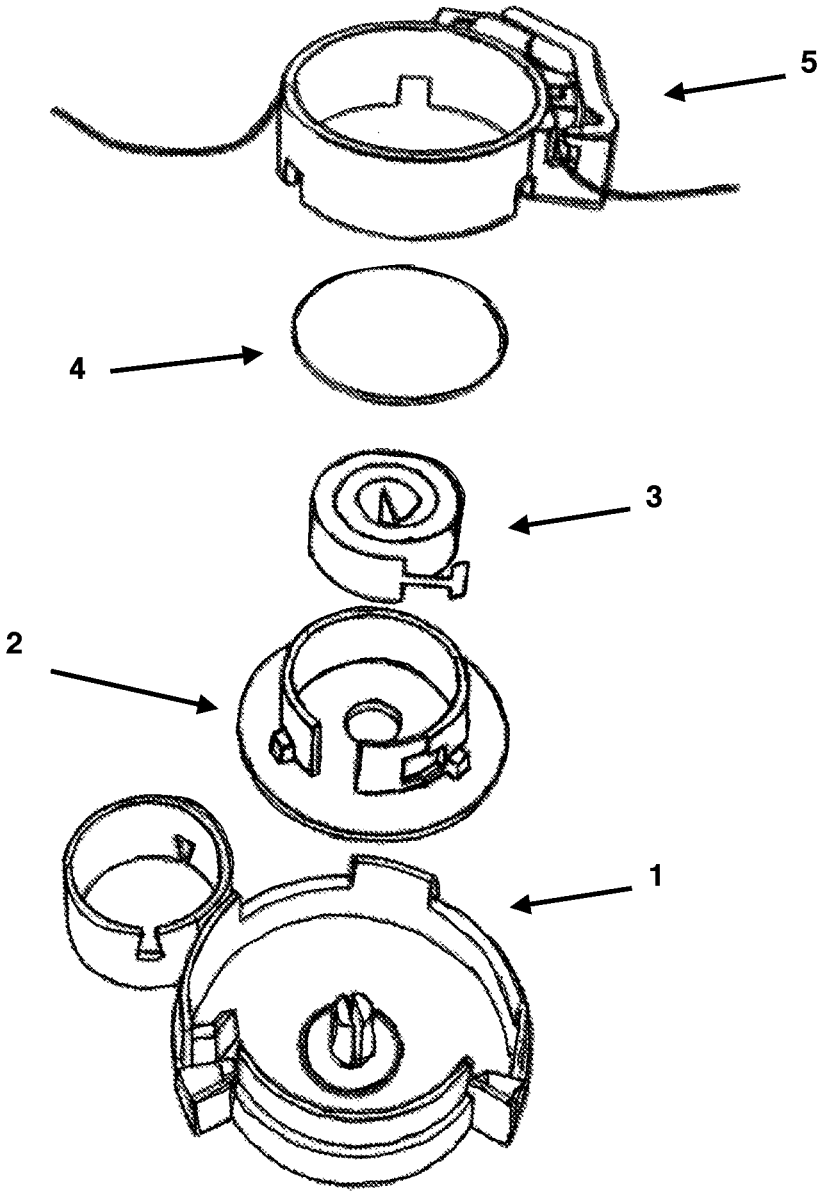
FIG. 2 shows an exploded view of the thread tensioner device, according to the present invention.

The components of the invention and their structural relationships will be explained in conjunction with FIGS. 2-9*b*. The thread tensioner device 100 is shown in FIG. 2 including a base 1 provided to receive and enclose a moving piece 2. An elastic element 3 is positioned inside the moving piece 2 and a lid 4 is provided to cooperate with the moving piece 2 for enclosing the elastic element 3. A ring element 5 is provided with means to structurally engage the moving piece 2 to provide the retractable and tension features of the invention as will be explained below.

Figure 3:
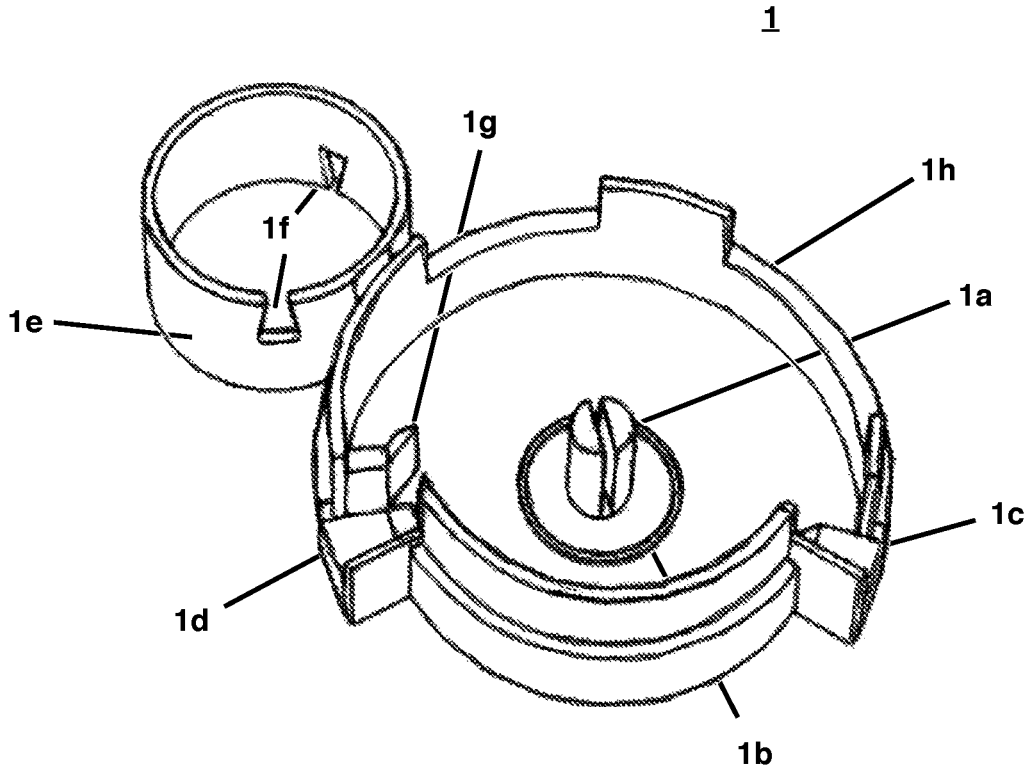
FIG. 3 shows a base of the thread tensioner device, according to the present invention.

The base 1 is provided with a static element 1*a* centrally positioned and upwardly extending from a floor of the base 1 as shown in FIG. 3. The static element 1*a* includes a passthrough opening 1*b* configured to slidably receive a second end 3*b* of the elastic element 3. As can be appreciated from the Figures, a first inlet opening 1*c* and a first outlet opening 1*d* are provided to allow inserting thread 5*c* into and out of said base 1. A base wall 1*h* upwardly extends from the floor to provide an enclosing area that will enclose the movable piece 2 and the elastic element 3. A detent element 1*g* is specifically provided inside the enclosing area near said first outlet opening 1*d* to structurally engage the release element 5*e* of the ring element 5 as will be explained below. One important feature of the present invention is that the ring element 5 has an integrated holding element 1*e* configured to receive a finger of a user to hold the retractable thread tensioner of the present invention while in use. Moreover, the integrated holding element 1*e* further includes a pair of openings 1*f* configured to receive a needle 103 of a threading device while the retractable thread tensioner of the present invention is not in use.

Figure 4:
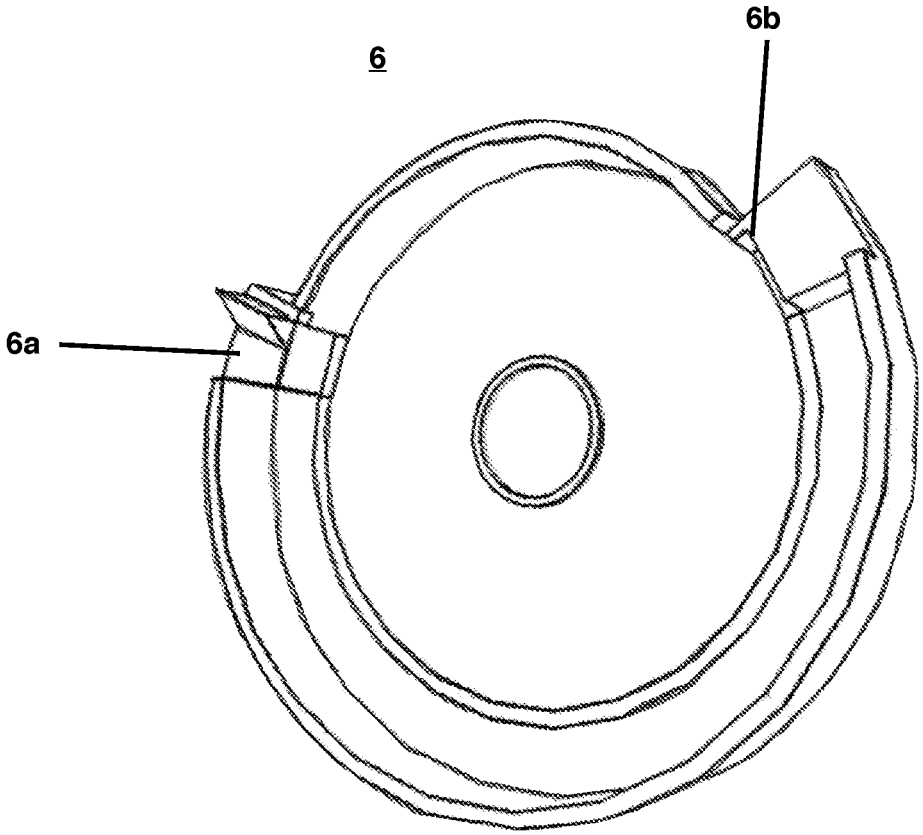
FIG. 4 shows a lid of the thread tensioner device, according to the present invention.
Figure 5:
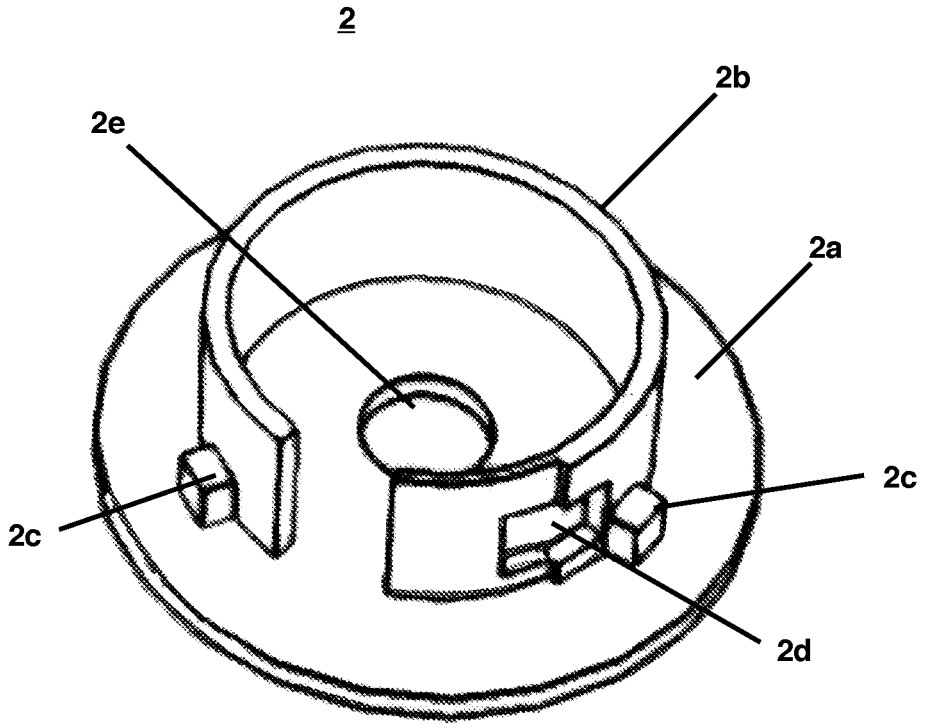
FIG. 5 shows a movable element of the thread tensioner device, according to the present invention.
Figure 6:
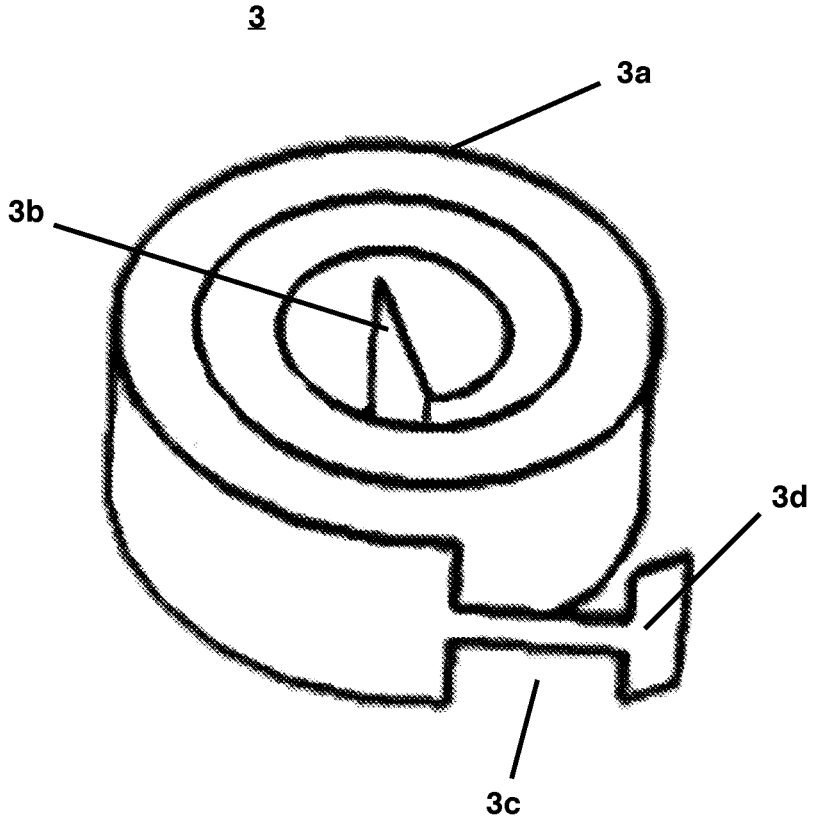
FIG. 6 shows an elastic element of the thread tensioner device, according to the present invention.
Figure 7:
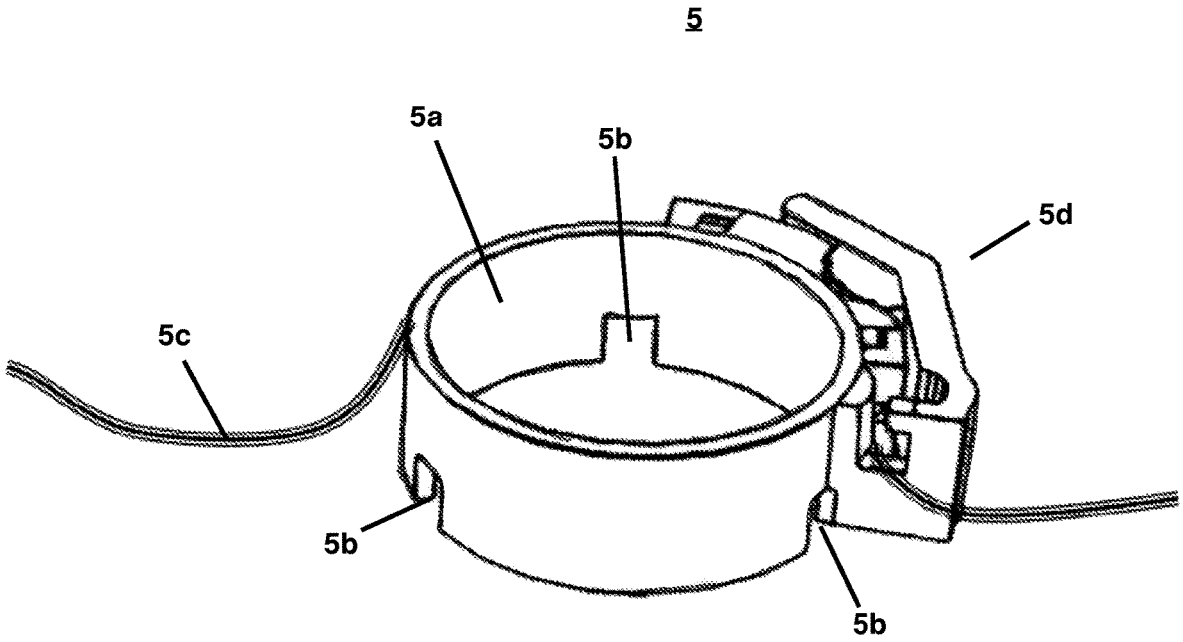
FIG. 7 shows a ring element of the thread tensioner device, according to the present invention.
Figure 11:
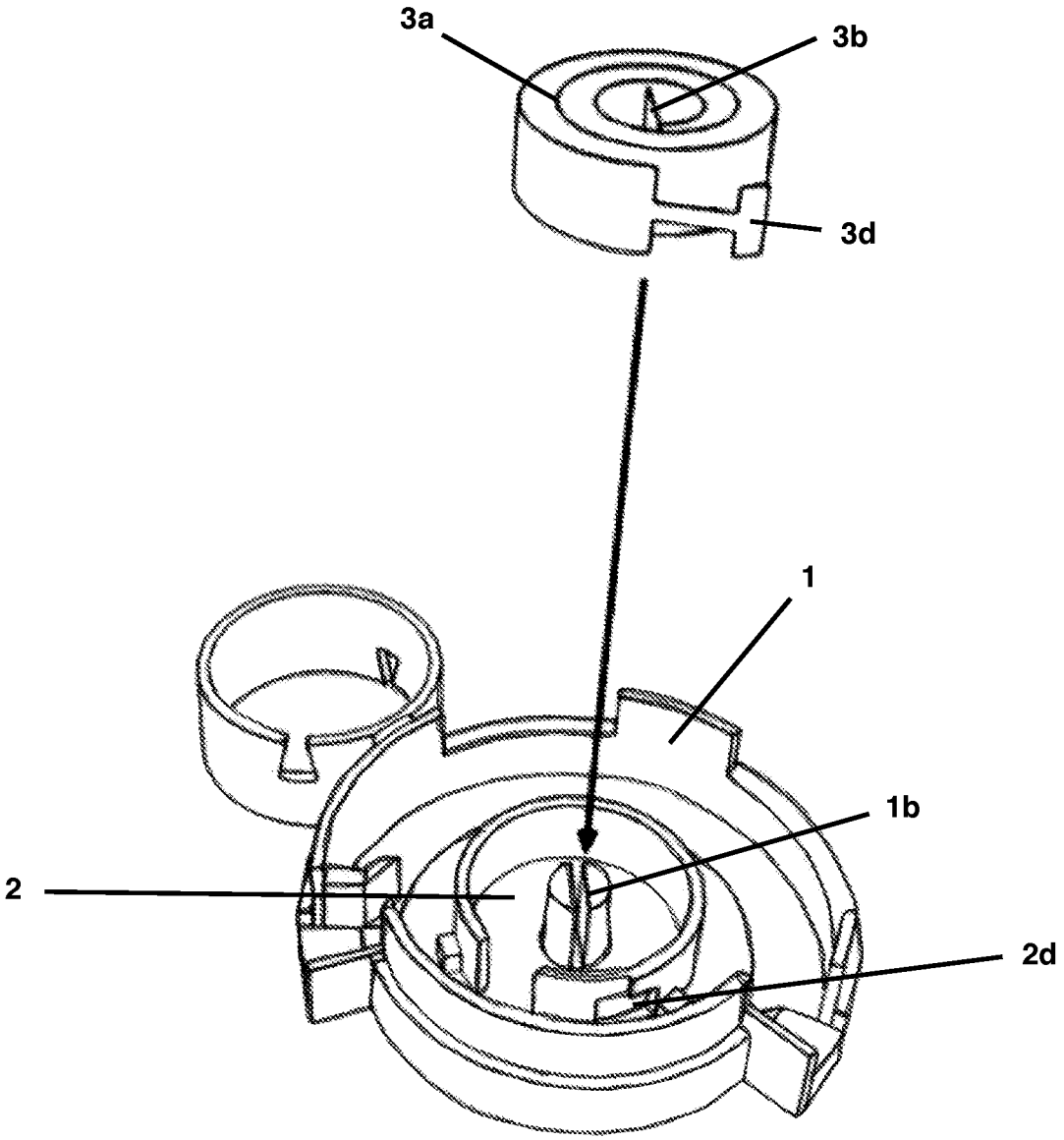
Figure 12:
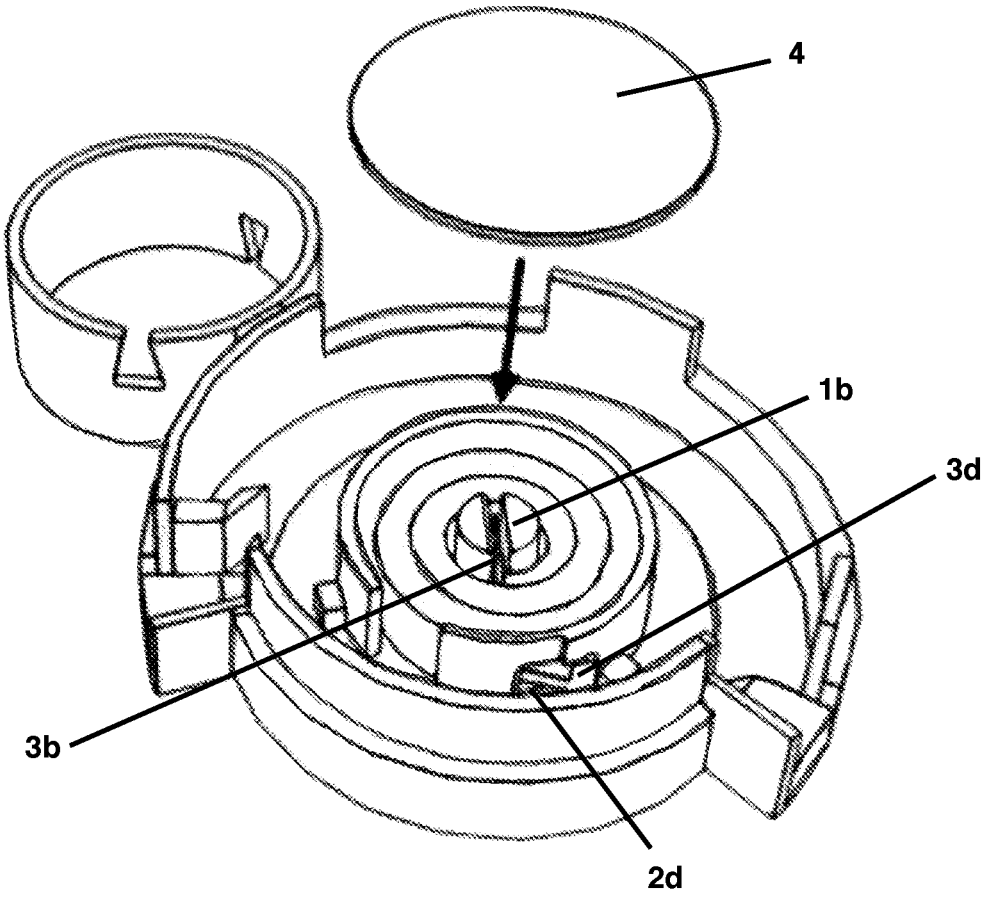

FIG. 4 shows an outer lid 6 configured to be positioned on top of the base 1 to enclose the movable piece 2 and the elastic element 3. A second inlet opening 6*b* and a second outlet opening 6*a* are provided on the outer lid 6 to mate with the second inlet opening 1*c* and the second outlet opening 1*d*, respectively to form a thread input and a thread output. FIG. 5 shows in more detail the movable piece 2 that includes a floor 2*a* having a centrally-located passthrough hole 2*e* configured to receive the static element 1*a* of the base 1 as shown in FIG. 11 when the retractable thread tensioner is assembled. A wall 2*b* upwardly extends from a movable piece base 2*a* to enclose the elastic element 3. At least one latching tab 2*c* is provided on the outer surface of the wall 2*b* to structurally engage with at least one latching hole 5*b* provided on the ring element 5 so that the rotation of the ring element 5 causes concurrent rotation of the movable piece 2. A retaining opening 2*d* is provided on the wall 2*b* to removably receive a first end 3*d* of the elastic element as will be explained below. FIG. 6 shows the elastic element 3 embodied as an elastic flat piece 3*a* wound up in a spiral configuration around a second end 3*b* of the elastic element 3. The elastic element 3 further comprises a first end 3*c* including a latch portion 3*d* configured to be removably inserted into the retaining opening 2*d* of the movable piece 2. It is important to point out that the ends 3*c* and 3*b* work in conjunction with the retaining opening 2*d* and the opening 1*b* of the static element 1, respectively, to maintain the elastic element 3 embodied fixed to the retractable thread tensioner while the movable piece 2 is rotated.

FIGS. 7-9*b* illustrate the ring element 5 according to the present invention. The ring element 5 comprises a circular continuous side wall 5*a* including at least one latching hole 5*b* on its bottom end configured to be structurally engaged to at least one latching tab 2*c* on the movable piece 2 in a mating relationship to ensure that both the ring element 5 and the movable piece 2 rotate concurrently. The elastic clip includes a release element 5*e* and an abutting element 5*g* that is configured to secure the thread 5*c* against an abutting portion 5*d* provided on the outer surface of the side wall 5*a*. According to an embodiment of the invention, the abutting portion 5*d* is a removable element that is slidably inserted into a receiving tabs 5*f* as can be appreciated on FIGS. 8-9*b*. Moreover, the abutting portion 5*d* is embodied as a concave surface including a plurality of ribs 5*h* to provide additional friction between thread 5*c* and the abutting element 5*g* and abutting portion 5*d*.

Assembly of the retractable thread tensioner of the present invention will be explained on conjunction with FIGS. 10-15.

The movable piece 2 is positioned inside the base 1 ensuring that the static element 1*a* is inserted through the pass-through opening 2*e* of the movable piece 2. Then the elastic element 3 is positioned inside the movable piece 2 so that the second end 3*b* is inserted into the opening 1*b* and the first end latch portion 3*d* is inserted into the retaining opening 2*d* of the movable piece 2. Once the elastic element 3 is installed, an inner lid 4 is positioned on top of the movable piece 2 to enclose the elastic element 3 contained inside the movable piece 2.

Figure 8:
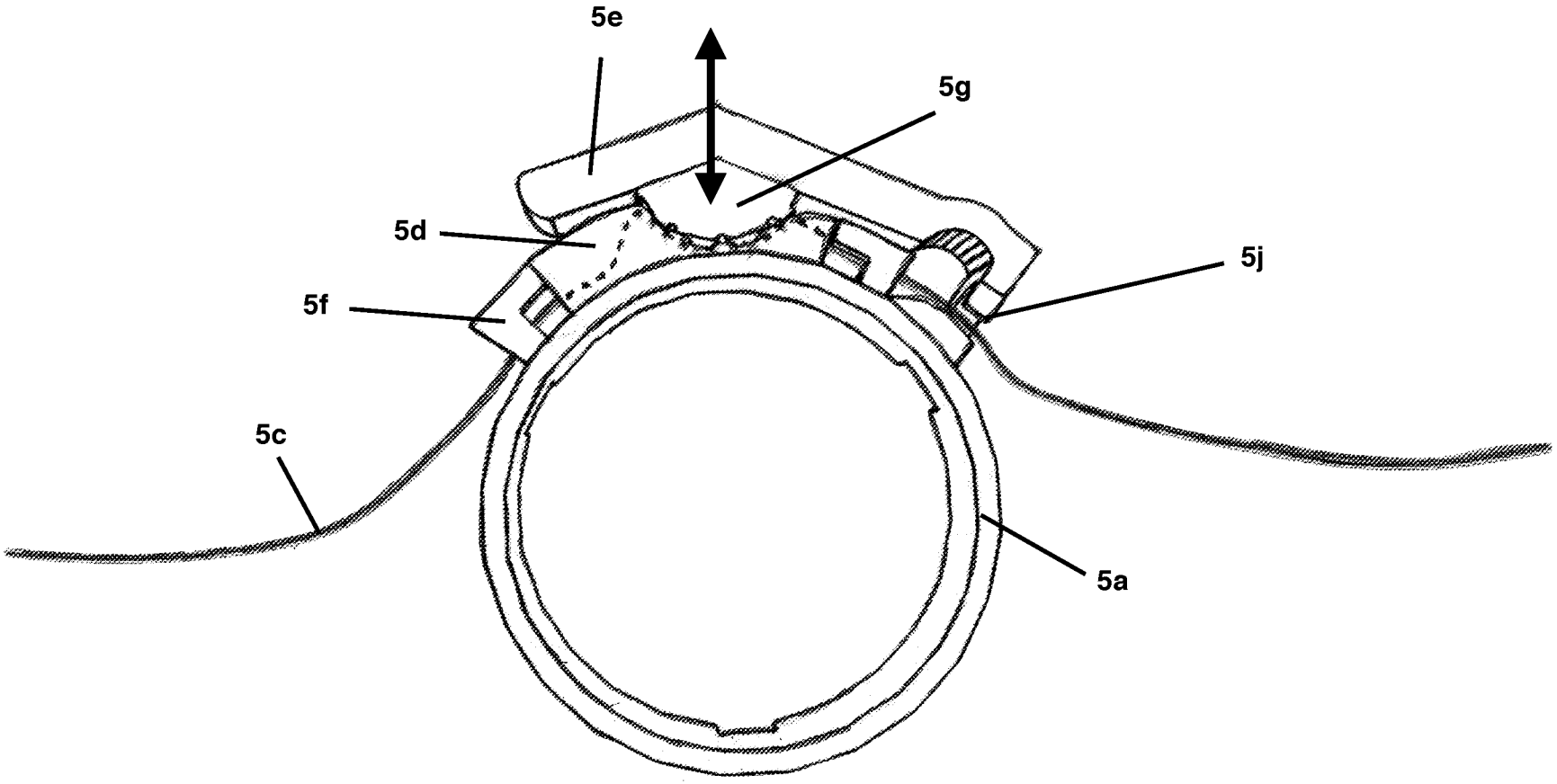
FIG. 8 shows a side view of the ring element pressing and securing a thread, according to the present invention.
Figure 9B:
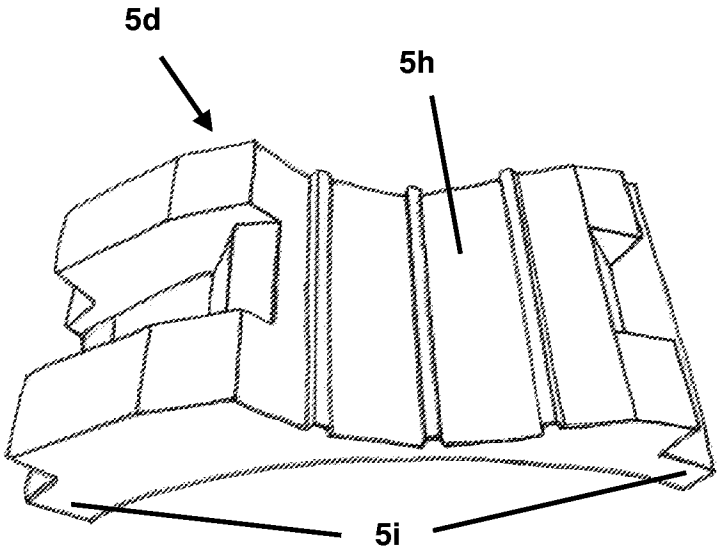
FIG. 9*b* shows an abutting portion element, according to the present invention.
Figure 9A:
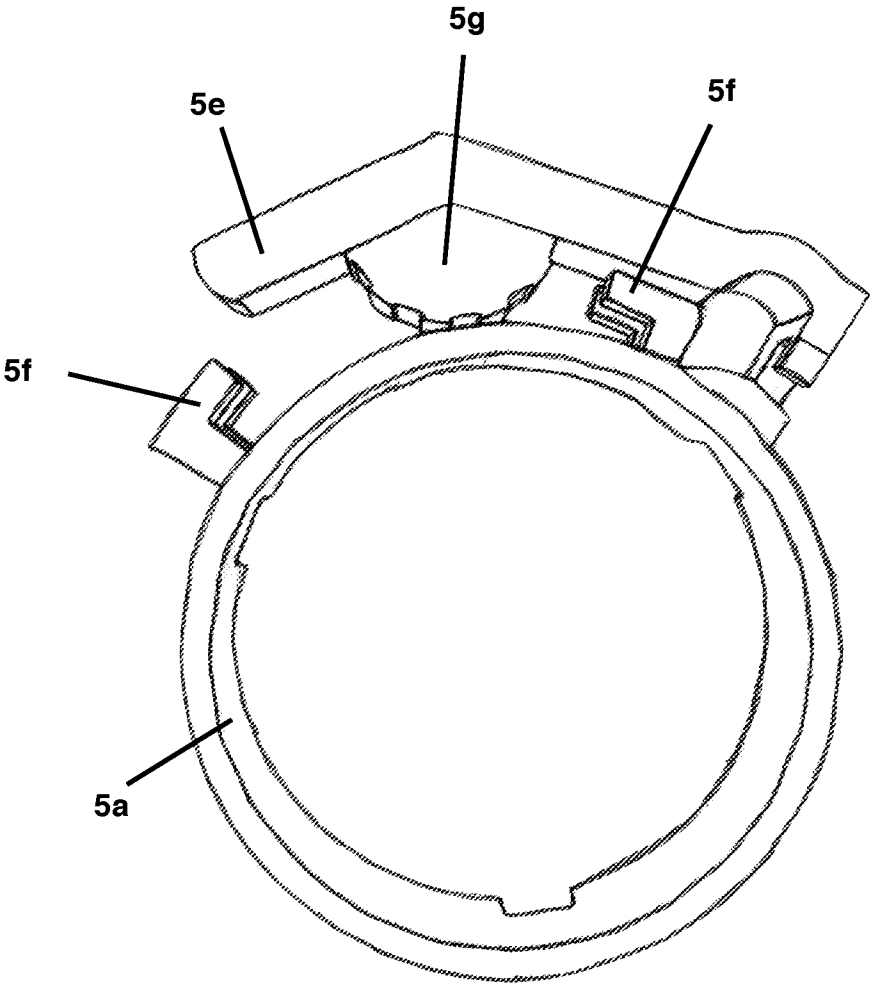
FIG. 9*a* shows another side view of the ring element, according to the present invention.
Figure 10:
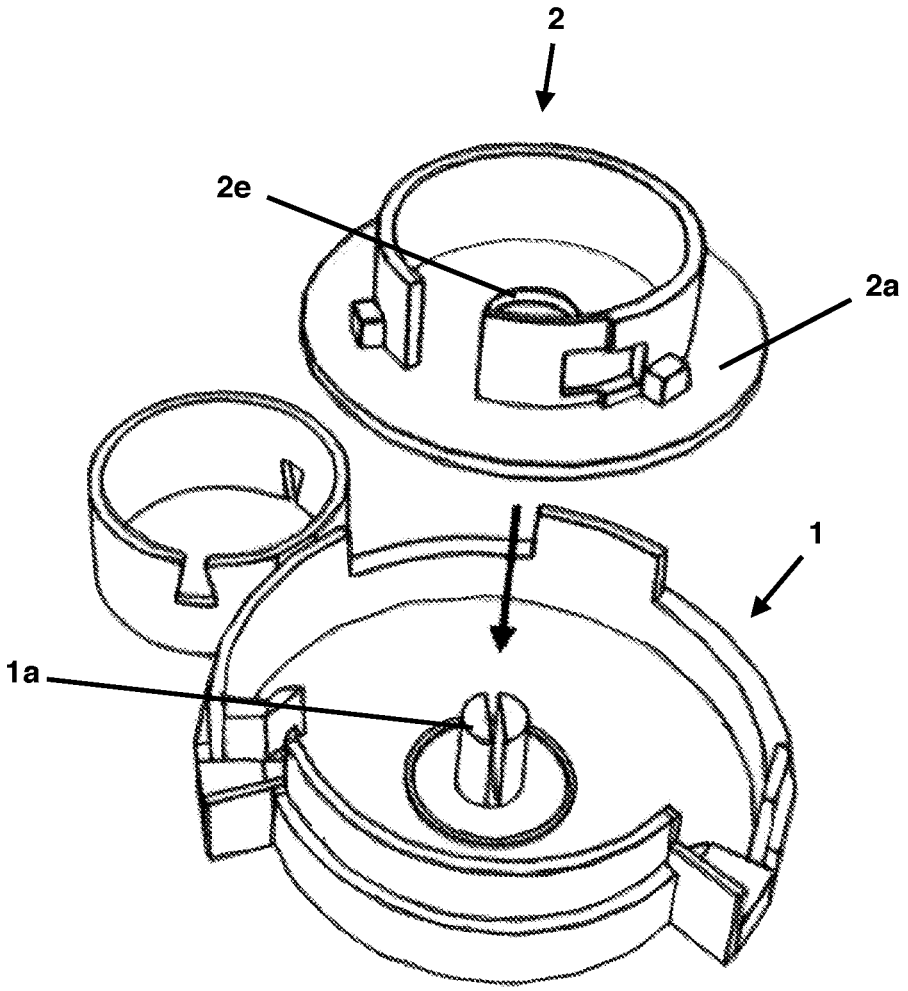
FIGS. 10-15 illustrate the order of assembling the components of the device, according to the present invention.

As a separate step, thread 5*c* must be positioned inside the elastic clip as shown in FIG. 8. This is done by pulling the release element 5*e* so that the thread 5C is positioned between the abutting element 5*g* and abutting portion 5*d* provided on the outer surface of the side wall 5*a*. Once the release element 5*e* is not pulled, release element 5*e* will return to its original position so that thread 5*c* will remain secured between the abutting element 5*g* and abutting portion 5*d*. This step can be performed at any time before the ring element 5 is placed inside the base 1.

Figure 13:
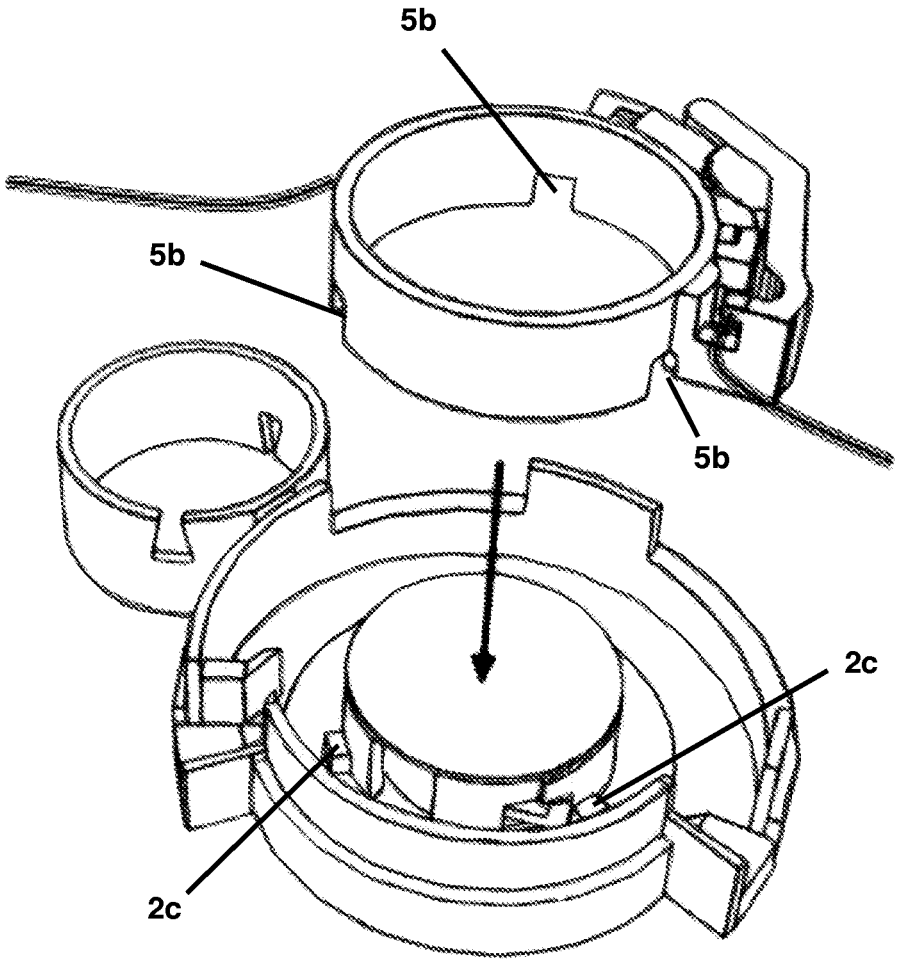
Figure 14:
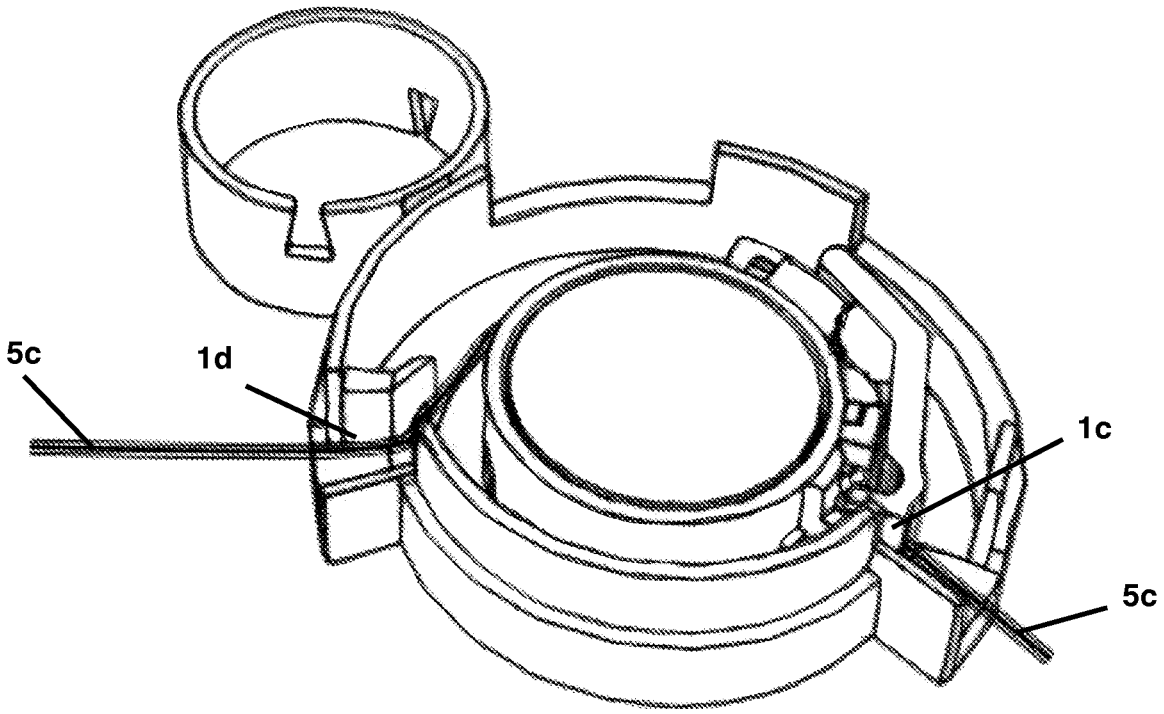
Figure 15:
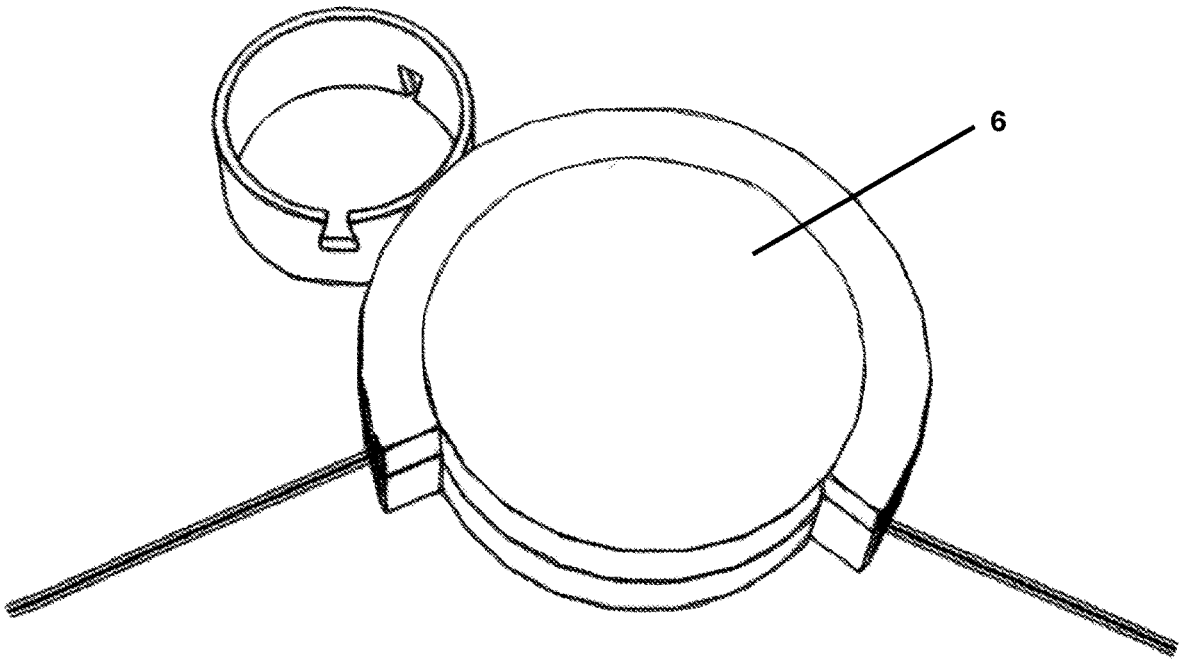
Figure 16:
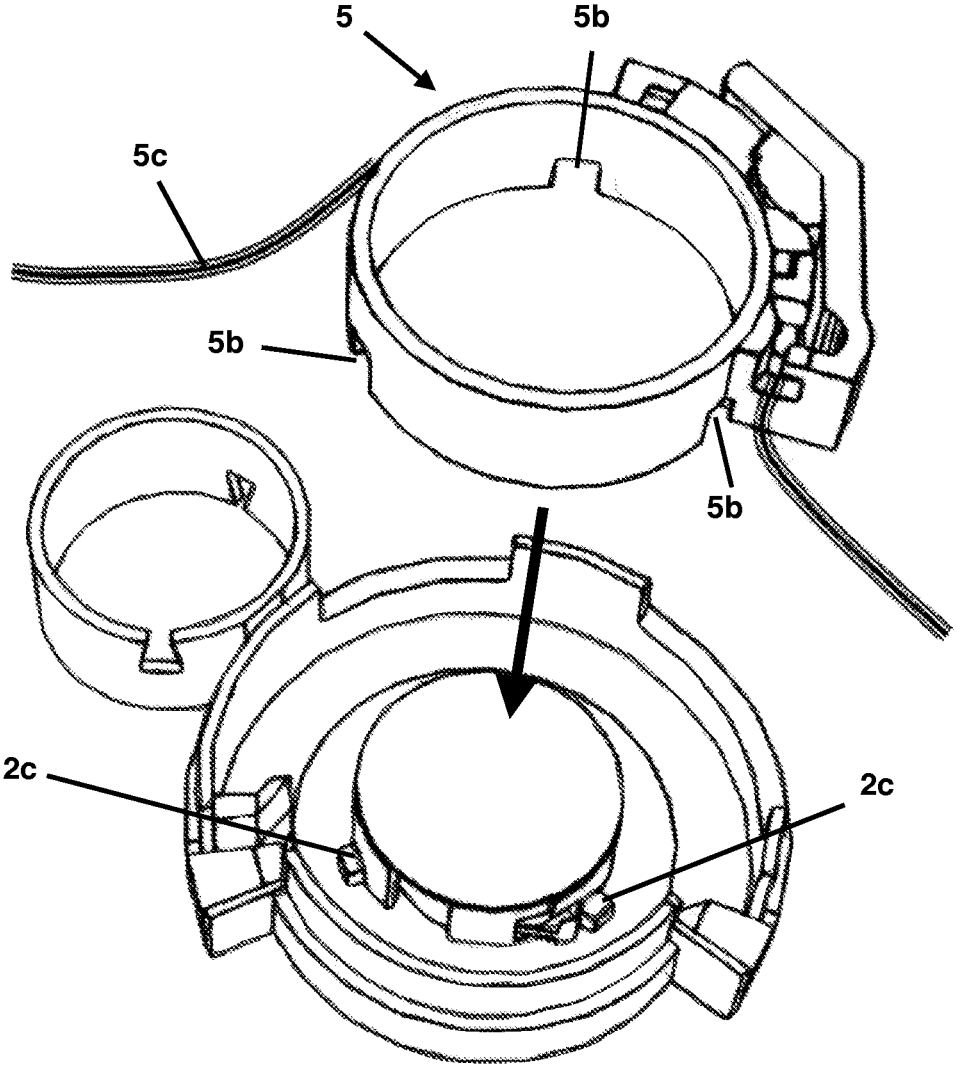
FIGS. 16-19 illustrate the order of using the device, according to the present invention.
Figure 17:
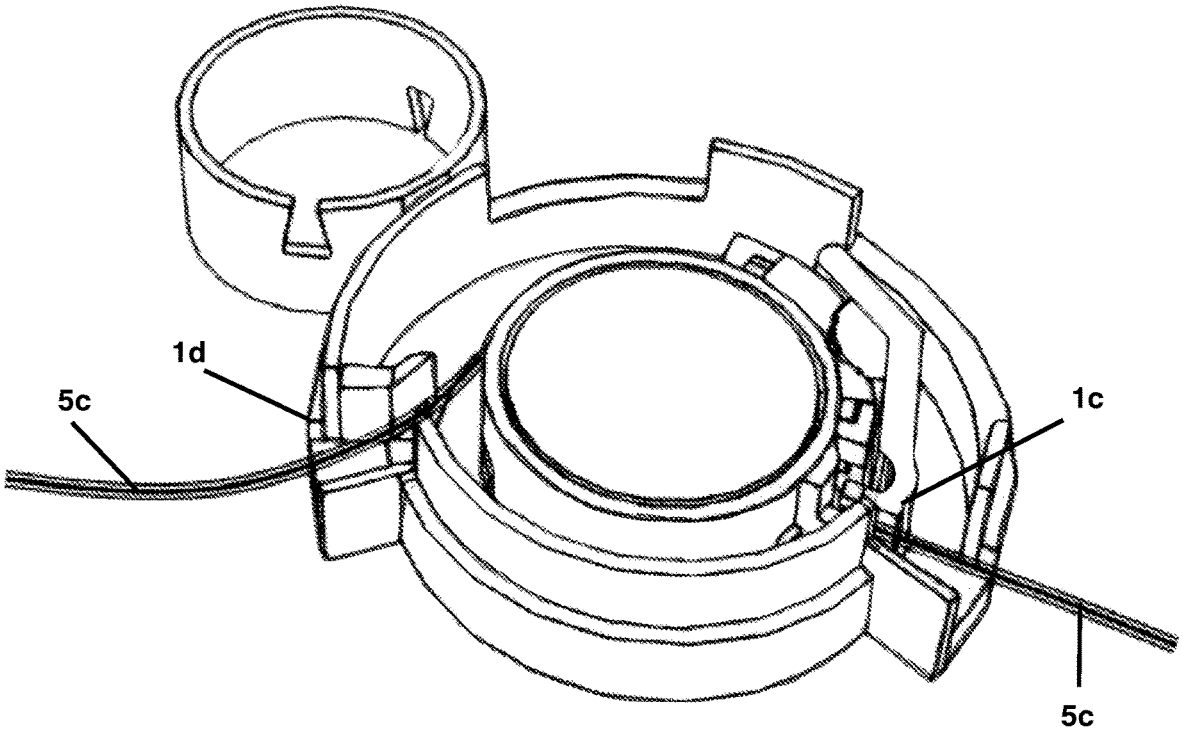

Continuing with the assembly procedure, the ring element 5 is then positioned inside the base 1 ensuring that the at least one latching hole 5*b* is structurally engaged in a mating relationship to the at least one latching tab 2*c* of the movable piece 2 as shown in FIGS. 13 and 14. This arrangement is provided to ensure that the ring element 5 and movable piece 2 will rotate together at the same time when thread 5*c* is pulled or released as will be explained below. A first end of thread 5*c* leading to a supply of thread is positioned within the first inlet opening 1*c* and a second end of thread 5*c* used for threading is positioned within the first outlet opening 1*d* as shown in FIG. 14. Afterwards, the outer lid 6 is positioned on top of the base 1 to enclose the movable piece 2 and the elastic element 3 so that a second inlet opening 6*b* and a second outlet opening 6*a* structurally cooperate with said first inlet opening 1*c* and said first outlet opening 1*d* to form a thread input and a thread output as shown in FIG. 15.

Figure 18:
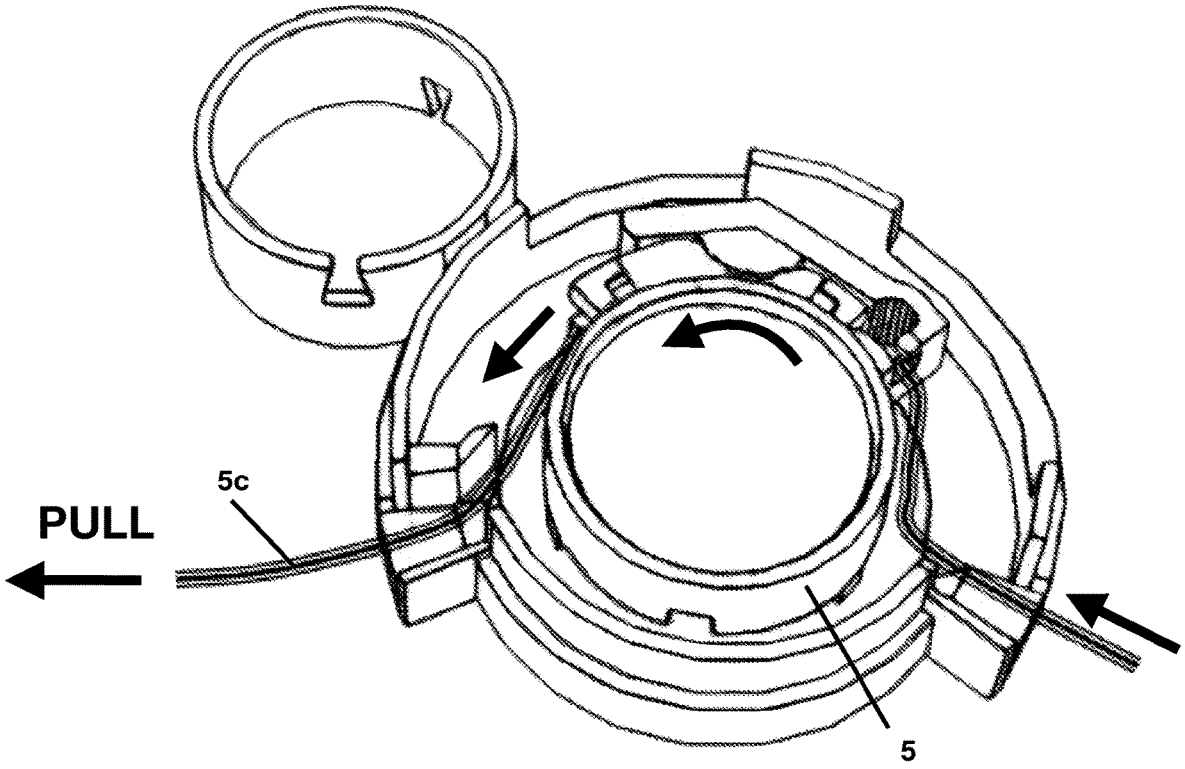
Figure 19:
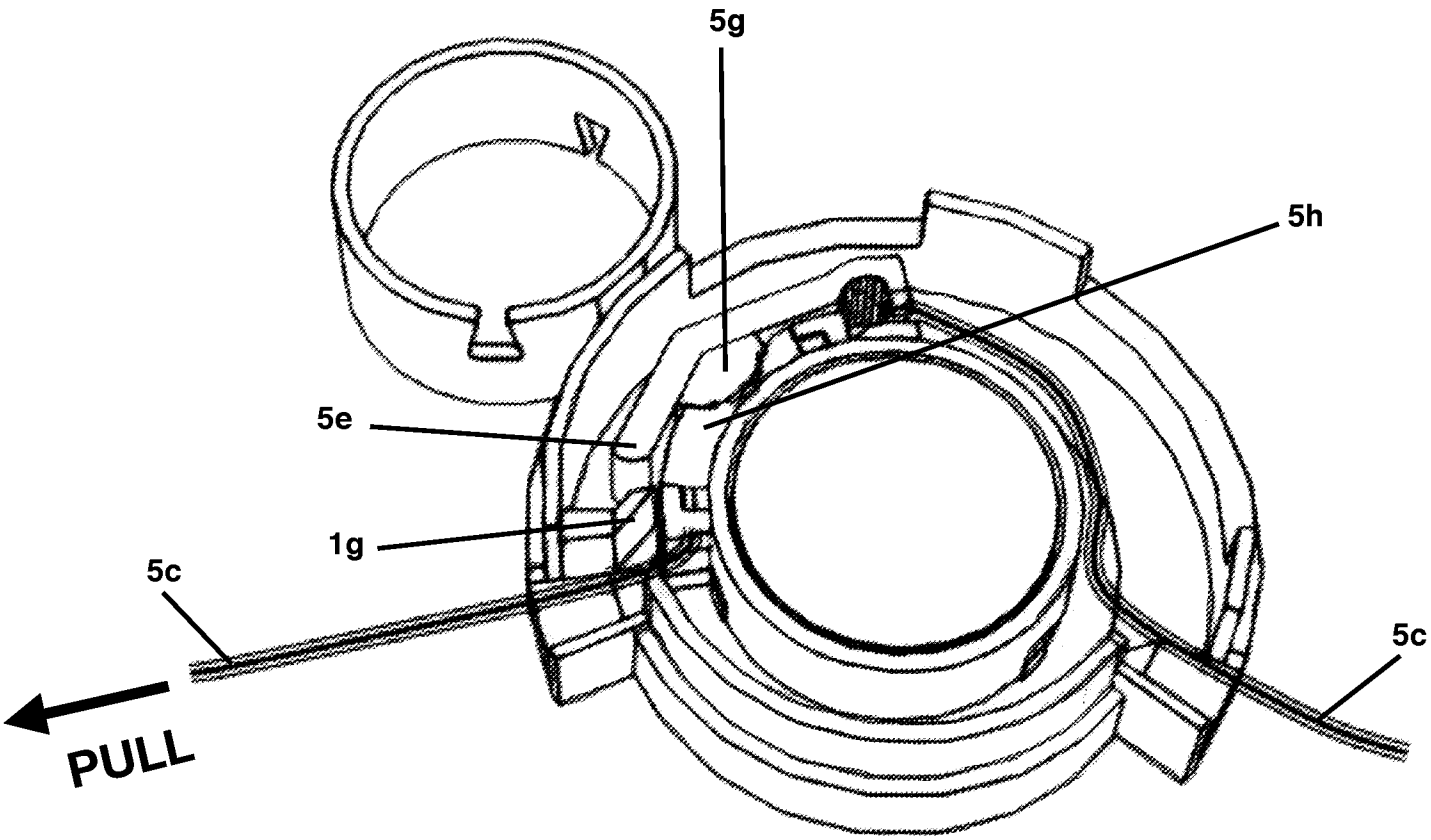

In operation, a user will pull thread 5*c* when additional thread 5*c* is needed as illustrated in FIG. 18. Since thread 5*c* is already secured to the ring element 5, a pull force will cause concurrent rotation of the ring element 5 and the movable piece 2 at the same time. This joint rotation is possible because the ring element 5 and the movable piece 2 are structurally secured together by means of the mating relationship between the at least one latching hole 5*b* and the at least one latching tab 2*c*. Resistance against the pull action is provided by the elastic element 3 so that when a user releases thread 5*c* the ring element 5 and the movable piece 2 move back to the original position prior to initiating the pull action. The thread 5*c* will continue to move secured to the elastic clip until the release element 5*e* reaches and makes contact with the detent element 1*g* provided on the base 1. After contact is made, further pulling the thread 5*c* will cause the detent element 1*g* to separate the release element 5*e* away from the abutting portion 5*d* so that the thread 5*c* is no longer secured to the elastic clip allowing the thread 5*c* to freely move inside the retractable thread tensioner providing the user with the additional thread 5*c* needed. Once the user releases the thread 5*c* and no more pulling force is provided, the ring element 5 and the movable piece 2 will begin to move back to the original position due to the elastic force exerted by the elastic element 3. While the ring element 5 and the movable piece 2 are rotating back, the detent element 1*g* stops contacting the release element 5*e* so that the release element 5*e* moves back to its original position securing the thread 5*c* against the abutting portion 5*d* securing the thread 5*c* to the elastic clip. Afterwards, the user only needs to pull the thread 5*c* and the operation is repeated again. As previously. explained, ring element 5 has an integrated holding element 1*e* configured to receive a finger of a user to hold the retractable thread tensioner of the present invention while in use and the integrated holding element 1*e* further includes a pair of openings 1*f* configured to receive a needle 103 of a threading device while the retractable thread tensioner of the present invention is not in use.

Although the present invention has been described herein with reference to the foregoing exemplary embodiment, this embodiment does not serve to limit the scope of the present invention. Accordingly, those skilled in the art to which the present invention pertains will appreciate that various modifications are possible, without departing from the technical spirit of the present invention.

I claim:

1. A retractable thread tensioner comprising:

a base having a static element upwardly extending from said base;

a movable piece contained within said base, said movable piece including a pass-through opening, at least one latching tab and a retaining opening, wherein said static element passes through said pass-through opening;

an elastic element contained within said movable piece, said elastic element having a first end and a second end, wherein said first end is affixed to said retaining opening and said second end is affixed to said fixed element; and a ring element having at least one latching hole and a release element configured to releasably secure a thread, wherein the at least one latching tab of said movable piece engages said at least one latching hole allowing said movable piece and said ring element to rotate inside said base when said ring element is rotated.

2. The retractable thread tensioner of claim 1, further comprising an inner lid position on top of said movable piece to enclose said elastic element.

3. The retractable thread tensioner of claim 1, further comprising an outer lid position on top of said base to enclose the movable piece and the elastic element.

4. The retractable thread tensioner of claim 1, wherein said base further comprises a holding element having a pair of openings configured to hold a weaving tool in place.

5. The retractable thread tensioner of claim 1, wherein said base further comprises a first inlet opening and a first outlet opening allowing passage of a thread through said retractable thread tensioner.

6. The retractable thread tensioner of claim 1, wherein said second end of the elastic element is inserted into an opening provided on said static element allowing said elastic element to return to an original position after being extended to a second position.

7. The retractable thread tensioner of claim 1, wherein said movable piece and said ring element rotate inside said base at the same time.

8. The retractable thread tensioner of claim 1, wherein the first end of said elastic element comprises a latch portion that is removably inserted into said retaining opening allowing said elastic element to extend from an original position.

9. The retractable thread tensioner of claim 1, wherein said release element comprises an elastic clip portion configured to releasably secure said thread against an abutting portion provided on the outer part of said ring element.

10. The retractable thread tensioner of claim 9, wherein said abutting portion is removable.

11. The retractable thread tensioner of claim 9, wherein the elastic clip portion is biased against said abutting portion.

12. The retractable thread tensioner of claim 1, wherein said base further comprises a detent element configured to limit rotation of said ring element inside said base.

13. The retractable thread tensioner of claim 1, wherein said base further comprises a detent element configured to engage the release element forcing said release element to release said thread.

14. The retractable thread tensioner of claim 5, wherein said outer lid comprises a second inlet opening and a second outlet opening mating with said first inlet opening and said first outlet opening to form a thread input and a thread output, respectively.

15. The retractable thread tensioner of claim 1, wherein said ring element moves the thread inside said base until the release element reaches a detent element provided on said base.

16. The retractable thread tensioner of claim 15, wherein said detent element structurally engages the release element forcing said release element into releasing said thread allowing free movement of said thread while said detent element is structurally engaged to said release element.

17. The retractable thread tensioner of claim 15, wherein said thread is secured by said release element and said ring element retracts to an original position once said detent element is no longer structurally engaging said release element.

18. The retractable thread tensioner of claim 1, wherein the ring element is removed from the retractable thread tensioner so that said thread is secured by said release element.

19. The retractable thread tensioner of claim 17, wherein the elastic element forces the ring element to retract to said original position.

* * * * *